US009687121B2

(12) United States Patent
Ciavarella et al.

(10) Patent No.: US 9,687,121 B2
(45) Date of Patent: Jun. 27, 2017

(54) COMPACT FOAM AT A DISTANCE PUMPS AND REFILL UNITS

(71) Applicant: GOJO Industries, Inc., Akron, OH (US)

(72) Inventors: Nick E. Ciavarella, Seven Hills, OH (US); Aaron D. Marshall, Uniontown, OH (US); John J. McNulty, Broadview Heights, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 14/511,890

(22) Filed: Oct. 10, 2014

(65) Prior Publication Data

US 2015/0102067 A1 Apr. 16, 2015

Related U.S. Application Data

(60) Provisional application No. 61/889,332, filed on Oct. 10, 2013.

(51) Int. Cl.
*A47K 5/14* (2006.01)
*A47K 5/12* (2006.01)
(Continued)

(52) U.S. Cl.
CPC ..... *A47K 5/14* (2013.01); *B05B 7/0037* (2013.01); *B05B 7/2491* (2013.01);
(Continued)

(58) Field of Classification Search
CPC A47K 5/14; A47K 5/1211; A47K 2005/1218; B05B 7/2491; B05B 7/0037; B05B 9/047; B05B 11/3015
See application file for complete search history.

(56) References Cited

U.S. PATENT DOCUMENTS 5,462,208 A * 10/1995 Stahley ..... B05B 7/0037 222/190
7,819,289 B2 10/2010 Willis
(Continued)

FOREIGN PATENT DOCUMENTS

EP 1974640 A2 12/2008

OTHER PUBLICATIONS

International Search Report and Written Opinion from International Application No. PCT/US2014/060009, date of mailing Jan. 19, 2015.

*Primary Examiner* — Nicholas J Weiss
(74) *Attorney, Agent, or Firm* — Calfee, Halter & Griswold LLP

(57) ABSTRACT

Exemplary foam pumps, refill units and foam dispenser systems are disclosed herein. One exemplary refill unit includes a container and a foam pump secured to the container. The foam pump includes an outer housing, an inner housing and a cap. An air pump chamber is formed at least in part by the inner housing. In addition, a liquid pump chamber is formed at least in part by the inner housing. At least a portion of the liquid pump chamber is also formed by the outer housing. An air outlet is located at the bottom of the air pump chamber, which connects to an air outlet passage formed at least in part by the outer housing and the inner housing. Air and liquid dispense tubes are included as well as a mixing chamber located remotely from the foam pump.

18 Claims, 3 Drawing Sheets

(51) Int. Cl.

| | |
|---|---|
| ***B05B 7/00*** | (2006.01) |
| ***B05B 7/24*** | (2006.01) |
| ***B05B 11/00*** | (2006.01) |
| *B05B 9/047* | (2006.01) |

(52) U.S. Cl.
CPC ..... *B05B 11/3015* (2013.01); *A47K 5/1211* (2013.01); *A47K 2005/1218* (2013.01); *B05B 9/047* (2013.01)

(56) References Cited

U.S. PATENT DOCUMENTS

| | | | | |
|---|---|---|---|---|
| 8,002,151 | B2 * | 8/2011 | Matthews ..... | A47K 5/14 222/1 |
| 2008/0237266 | A1 | 10/2008 | Ciavarella | |
| 2009/0101679 | A1 | 4/2009 | Muderlak | |
| 2010/0140300 | A1 | 6/2010 | Lewis et al. | |
| 2013/0032614 | A1 | 2/2013 | Babikian et al. | |
| 2015/0291345 | A1 * | 10/2015 | Ophardt ..... | A47K 5/1207 222/401 |

* cited by examiner

COMPACT FOAM AT A DISTANCE PUMPS AND REFILL UNITS

RELATED APPLICATIONS

This application claims priority to and the benefits of U.S. Provisional Patent Application Ser. No. 61/889,332 filed on Oct. 10, 2013 and entitled "COMPACT FOAM AT A DISTANCE PUMPS AND REFILL UNITS," which is incorporated herein by reference in its entirety.

TECHNICAL FIELD

The present invention relates generally to foam-at-a-distance dispenser systems and more particularly to counter-mount foam-at-a-distance systems, pumps and refill units.

BACKGROUND OF THE INVENTION

Liquid dispenser systems, such as liquid soap and sanitizer dispensers, provide a user with an amount of liquid upon actuation of the dispenser. Counter mount systems often have an air pump and a liquid pump located under the counter and an outlet nozzle located above the counter. Many systems create foam below the counter and push the foam up though a dispense tube to the outlet nozzle located at the end of a spout. Pushing foam up the dispense tube requires a significant amount of energy which drains batteries. In addition, residual foam may break down in the dispense tube and thus, the next dose of soap may contain liquid or a poor quality foam. One solution is to push liquid and air up separate tubes and mix the liquid and air near the end of the spout. U.S. Pat. No. 7,819,289, which is incorporated herein in its entirety, discloses separate air and liquid pumps feeding separate tubes to a foam at a distance nozzle. The separated air and liquid pumps are more difficult to replace as a refill unit. U.S. Pat. Publication 2008/02372266, which is also incorporated herein in its entirety, discloses a refill unit having a combined air and liquid pump that uses separate liquid and air tubes to feed liquid and air to a foam at a distance nozzle. Although this system is easier to replace as a refill unit, a drawback to the this system is the number of components required for assembly of the foam pump. Accordingly, there is a need for a compact low part count foam at a distance pump and refill unit for counter mount dispenser systems.

SUMMARY

Exemplary foam pumps, refill units and foam dispenser systems are disclosed herein. One exemplary refill unit includes a container and a foam pump secured to the container. The foam pump includes an outer housing, an inner housing and a cap. An air pump chamber is formed at least in part by the inner housing. An air piston is located at least partially within the air pump chamber. A liquid pump chamber is formed at least in part by the inner housing and a liquid piston is located at least partially within the liquid pump chamber. At least a portion of the liquid pump chamber is formed by the outer housing. An air outlet is located at the bottom of the air pump chamber. An air outlet passage is formed at least in part by the outer housing and the inner housing. An air dispense tube having a first end secured to the inner housing and a second end located remotely from the inner housing is also included. Similarly, a liquid dispense tube having a first end secured to the inner housing and a second end located remotely from the inner housing is provided. In addition, a mixing chamber is located proximate the second end of the liquid dispense tube and the second end of the air dispense tubes.

An exemplary foam pump includes an air pump chamber, a liquid pump chamber, an air outlet passage and a liquid outlet passage. The air pump chamber at least partially surrounds the liquid pump chamber. In addition, at least a portion of the liquid pump chamber surrounds a first portion of the air outlet passage and a second portion of the air outlet passage surrounds a portion of the liquid outlet passage.

Another exemplary refill unit for a foam dispenser includes a container having a neck. A foam pump is secured to the neck. The foam pump has an outer housing. At least a portion of the outer housing is located within the neck of the container. An inner housing located at least partially within the outer housing is also provided. A liquid pump chamber is formed at least partially by the inner housing, the outer housing, a liquid inlet valve and a liquid outlet valve. An air pump chamber is at least partially formed by the inner housing. In addition, an air outlet passage extends from the air pump chamber. The air outlet passage is at least partially formed by the inner housing and the outer housing. The liquid pump chamber is located at least partially within the air pump chamber. A liquid dispense tube extending upward from the foam pump and an air dispense tube extending upward from the foam pump are also provided. The liquid dispense tube and the air dispense tube remain stationary when the foam pump pumps air and liquid.

In this way, a simple and economical compact low part count foam at a distance pumps, refill units and systems are provided.

BRIEF DESCRIPTION OF THE DRAWINGS

These and other features and advantages of the present invention will become better understood with regard to the following description and accompanying drawings in which.

DETAILED DESCRIPTION

Figure 1:
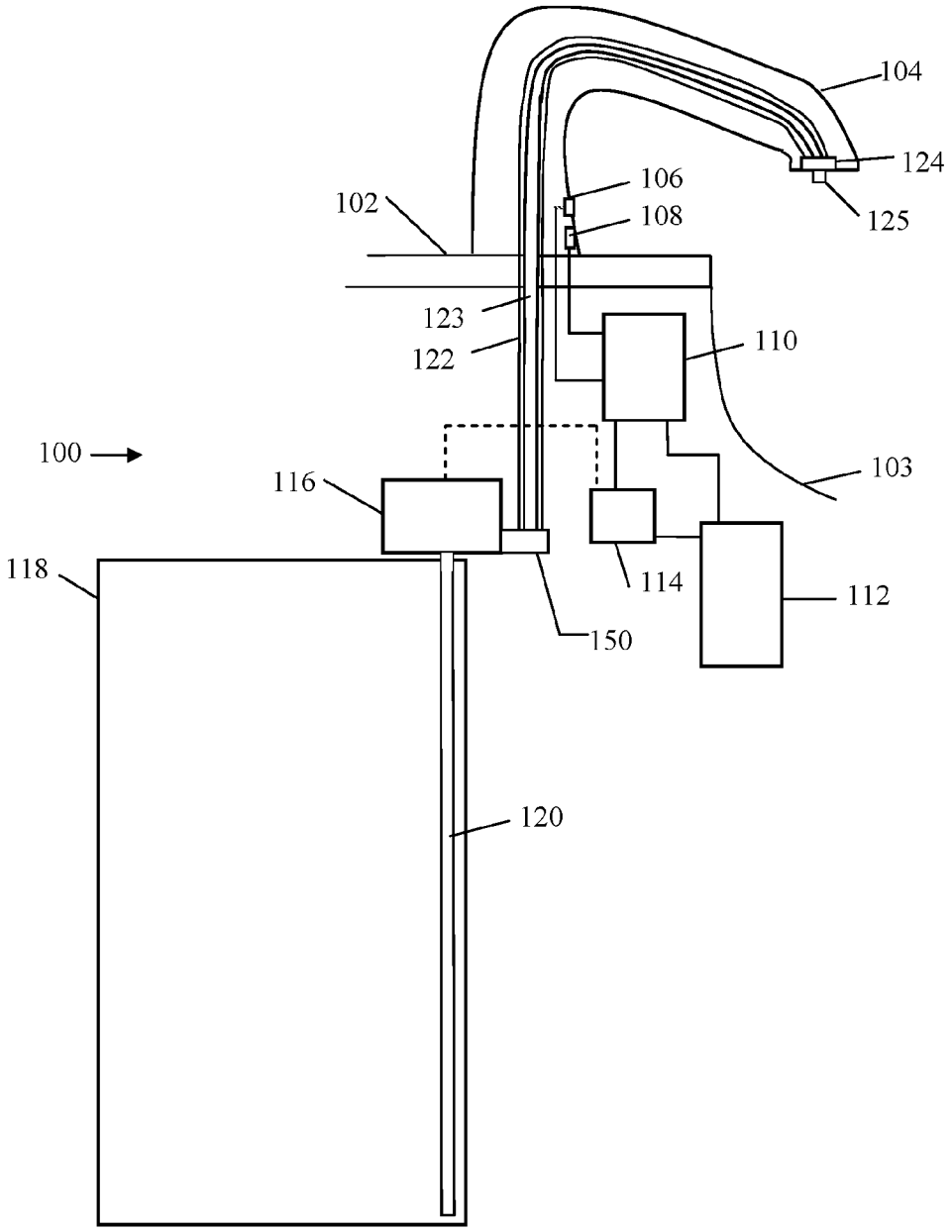
FIG. 1 is a schematic view of an exemplary embodiment of a foam-at-a-distance dispenser system.

FIG. 1 is a schematic view of an exemplary embodiment of a foam-at-a-distance dispenser system 100. Foam-at-a-distance dispenser system 100 includes a spout 104, which is mounted to a countertop 102 having a sink basin 103. Spout 104 includes an object sensor 106, such as, for example, an infrared sensor, a motion sensor, a capacitance sensor or the like. Sensor 106 is in circuit communication with controller 110. Controller 110 may include a processor, a microprocessor or the like. Controller 110 also includes any necessary memory or circuitry required to perform the functions described herein. In addition, in some embodiments, spout 104 includes feedback indicator 108. Feedback indicator 108 may provide a visual and/or an audible feedback to a user. Exemplary visual feedback indicators maybe, for example, one or more light emitting diodes (LEDs). Controller 110 is also in circuit communication with pump actuator 114. Pump actuator 114 may be, for example, a motor that rotates one or more gears to actuate foam-at-a-distance dispenser pump 116.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

A power source 112 provides power to the controller 110, pump actuator 114 and any other components that require power. Power supply 112 may be one or more batteries, or may be a hard wired power source and draw power, from for example, an 120 VAC line. In such case, power supply 112 may include any necessary transformers, rectifiers, or power conditioning devices to obtain suitable power for the components described herein. Pump actuator 114 actuates foam-at-a-distance pump 116.

Foam-at-a-distance pump 116 is connected to inlet dip tube 120, which is located in container 118, and liquid dispense tube 123 and air dispense tube 122 (which in some embodiments are coaxial) that extend up through spout 104 to mixing chamber 124, where the liquid and air are mixed together and dispensed through outlet 125. In some embodiments, container 118, foam pump 116, dip tube 120 and outlet tubes 122, 123 form a refill and may be replaced when container 118 runs out of fluid or stops working. Container 118 contains a fluid, such as, for example, a foamable soap or sanitizer.

Controller 110 includes logic or circuitry for operating pump actuator 114 that operates pump 116 and the other electronic components identified above as required. "Logic" is synonymous with "circuit" or "circuitry" and includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Figure 2B:
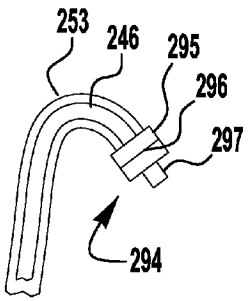
FIG. 2B is a cross-section of an exemplary mixing nozzle.
Figure 2A:
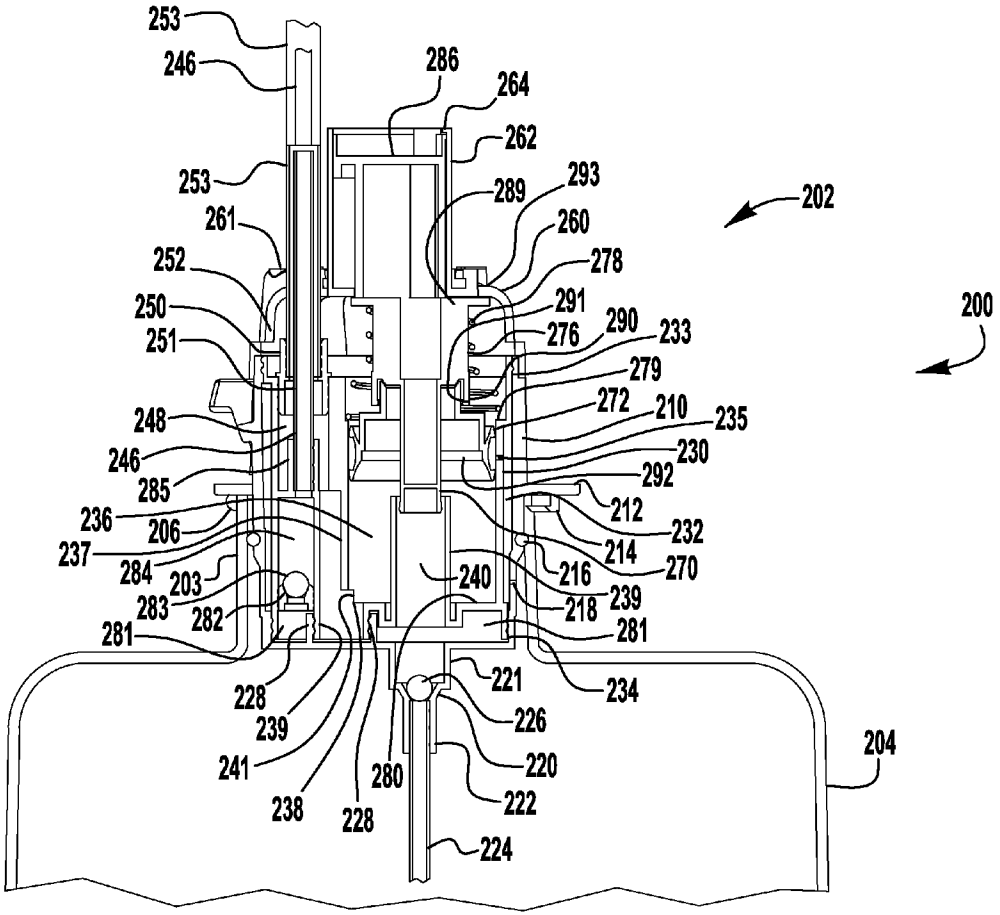
FIG. 2A is a partial cross-section of an exemplary refill unit.
Figure 3:
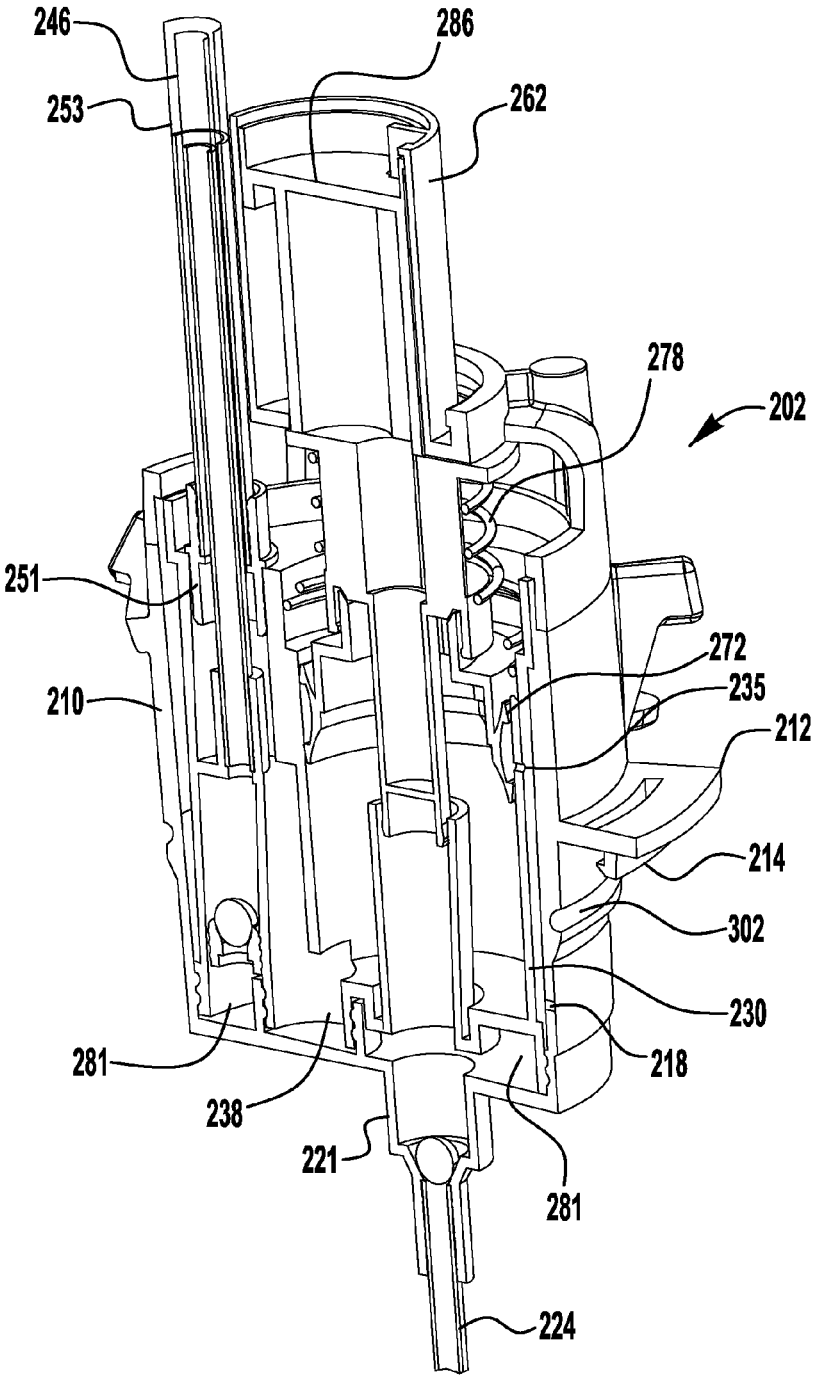
FIG. 3 is a cross-section of a prospective view of the foam pump of FIG. 2A.

FIG. 2A is a partial cross-sectional view of a first exemplary embodiment of a refill unit 200 having a compact foam-at-a-distance pump 202 suitable for use in remote foam-at-a-distance system 100. FIG. 3 is a partial cross-sectional a prospective view of the foam at a distance pump 202. Foam-at-a-distance pump 202 includes an outer housing 210 that is connected to the neck 203 of container 204. Outer housing 210 includes one or more tabs 212 that have one or more connectors 214. The one or more connectors 214 snap over one or more projections 206 on neck 203 of container 204. In some embodiments, a seal 216, such as, for example, an o-ring, resides in an indentation 302 (FIG. 3) in outer housing 210 to form a seal against the inner surface of neck 203.

Outer housing 210 has an container vent aperture 218 located between the neck 203 and outer housing 210 below seal 216. In addition outer housing includes an annular projection 221. A valve seat 220 is located at the base of annular projection 221. A valve 226, such as, for example, a ball valve, is located within annular projection 221 and engages valve seat 220 to prevent fluid from flowing out of foam pump 203 back into container 204. A second annular projection 222 is located below the valve seat 220 and forms a dip tube 224 connector, for connecting the dip tube 224 to outer housing 210. In addition, outer housing 210 also includes annular projection 228.

Foam-at-a-distance pump 202 includes an inner housing 230 Inner housing 230 has an upper cylindrical portion 233 that engages with outer housing 210. Similarly, inner housing 230 has a lower cylindrical portion 234 that engages with outer housing 210. The engagements may be snap-fit engagements, a friction fit engagements, adhesive engagements, welded engagements or the like. An air passage 232 is located between inner housing 230 and outer housing 210. Inner housing 230 includes an air inlet aperture 235 located through a sidewall of inner housing 230 into air passage 232. Air passage 232 is in fluid communication with container vent aperture 218 to vent container 204. In some embodiments, air inlet aperture 235 is located in an upper portion of inner housing 230 such that when air piston wiper seal 272 is located in its uppermost position, air piston wiper seal 272 seals air inlet aperture 230 and prevents air from entering or container 204 and prevents air or liquid from flowing out of container 204.

Inner housing 230 has a air pump chamber 236 formed by cylindrical wall 237, which in some embodiments, consists in part of the outside wall of inner housing 210. Inner housing 210 includes a base 280 that forms a portion of air pump chamber 236. An air outlet aperture 238 is located in a lower portion of air pump chamber 236, and in some embodiments is located in a portion of the base 280 of air pump chamber 236. In some embodiments, the air outlet aperture 238 is located in at least a portion of the cylindrical wall 237 of the air pump chamber. Inner housing 230 includes an annular projection 239 that engages with annular projection 228 of outer housing 210. The engagement may be a snap-fit engagement, a friction fit engagement, an adhesive engagement, a welded engagement or the like. The engagement between annular projection 239 of inner housing 230 and annular projection 228 of outer housing 210 forms an air tight seal and forms a portion of air outlet passage 241. Air outlet passage 241 opens into a second cylindrical air outlet passage 248.

Located within air pump chamber 236 is cylindrical liquid pump chamber 240. Cylindrical liquid pump chamber 240 is open to liquid chamber 281 formed in part by base 280, and outer housing 210. Liquid chamber 281 surrounds air passage 238. An opening 282 that forms a valve seat is located downstream of liquid chamber 281. A ball valve 283 seats against opening 282 to form a one-way valve allowing liquid to flow out of liquid chamber 281, but prevents liquid from flowing back into liquid chamber 281 once it passes one-way ball valve 283. A cylindrical outlet passage 284 retains ball valve 283. The liquid inlet and outlet valves are described as ball valves; however any type of one-way valve may be used. Located at the top of cylindrical outlet passage 284 is an annular projection 285 for retaining liquid outlet tube 246.

A fitment 250 is secured to second cylindrical air outlet passage 248. Fitment 250 may be secured to second air outlet passage 248 by, for example, a friction fit, and adhesive fit, or the like. Fitment 250 includes an opening 251 that allows liquid outlet tube 246 to pass through. Fitment 250 also includes an annular projection 252 that secures air outlet tube 253 to fitment 250. Accordingly, liquid outlet tube 246 is located within air outlet tube 253. As described with respect to FIG. 1, air outlet tube 253 and liquid outlet tube 246 extend up through a counter (not shown) and a spout (not shown) to a mixing chamber 295 (FIG. 2B) and outlet 297 (FIG. 2B) when the refill unit 200 is installed in a counter mount system.

A cap 260 is secured to outer housing 210. Cap 260 includes an opening 261 to allow liquid tube 246 and air tube 253 to pass through. Liquid tube 246 and air tube 253 are coaxial; however, in some embodiments, liquid tube 246 and air tube 253 are not coaxial. Cap 260 includes a cylindrical projection 262 located in the center of cap 260. Cylindrical projection 262 includes retaining ring 264 to retain actuator 286 within cylindrical projection 262. Actuator 286 engages piston body 289.

Piston body 289 includes a liquid piston 270, which reciprocates in liquid pump chamber 240 and engages the cylindrical wall 239. Piston body 289 includes projections 290 that engage and interlock with projection 291 on air piston 292. Air piston 292 which includes seal 272 that reciprocates in air pump chamber 236 to pump air. Seal 272 is a double wiper seal and when the air piston is in its rest position, air inlet aperture 235 is located so that double wiper seal 272 prevents air from passing through air inlet aperture 235. The liquid piston 270 and air piston 292 are biased to their rest positions by biasing member 278, which may be, for example, a spring. Biasing member 278 engages ledge 279 of inner housing member 230 and retaining ring 264.

FIG. 2B is a cross-section of an exemplary embodiment of a foaming nozzle 294. Foaming nozzle 294 connects to coaxial liquid dispense tube 246 and air dispense tube 253. Foaming nozzle 294 includes a mixing chamber 295, one or more foaming members 296, such as, for example, a screen, and an outlet 297.

During operation, actuator 286 is moved downward moving liquid piston 270 and air piston 292 downward compressing liquid chamber 240 and air pump chamber 236. Liquid flows out of liquid pump chamber 240, 281, past one way outlet valve 282 and up liquid dispense tube 246 into mixing chamber 295. Air flows out of air pump chamber 236 through air outlet passages 241, 248 up air dispense tube 253 into mixing chamber 295. The air and liquid mix together and are forced through mix media 296 and out of nozzle 294 in the form of a foam. When actuator 286 is released, biasing member 278 urges piston body 289 upward which causes liquid piston 270 to move upward expanding liquid chamber 240, sealing ball valve 283 against seat 282 and drawing liquid up through dip tube 224 past ball valve 226 into liquid chamber 240, 281. Simultaneously, air is drawn through outlet nozzle 297, air outlet tube 253, air passages 248, 238 and into air pump chamber 236. In some embodiments, a one-way air inlet valve (not shown) allows air to flow into air pump chamber 236 without flowing through the outlet passages 238, 248. When valve body 289 moves to its rest position, pump 202 is primed and ready to dispense foam.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A refill unit comprising:
a container;
a foam pump secured to the container;
the foam pump having
an outer housing;
an inner housing; and
an air pump chamber formed at least in part by the inner housing;
an air piston located at least partially within the air pump chamber;
a liquid pump chamber formed at least in part by the inner housing;
a liquid piston located at least partially within the liquid pump chamber;
at least a portion of the liquid pump chamber formed by the outer housing;
at least a portion of the air pump chamber surrounds the liquid pump chamber;
an air outlet located at the bottom of the air pump chamber;
an air outlet passage formed at least in part by the outer housing and the inner housing;
an air dispense tube having a first end secured to the inner housing and a second end located remotely from the inner housing;
a liquid dispense tube having a first end secured to the inner housing and a second end located remotely from the inner housing; and
a mixing chamber located proximate the second end of the liquid dispense tube and the second end of the air dispense tube.

2. The refill unit if claim 1 wherein a portion of the liquid pump chamber at least partially surrounds the air outlet passage.

3. The refill unit if claim 1 wherein the outer housing further comprises a liquid inlet.

4. The refill unit if claim 1 further comprising a cap secured to the outer housing, wherein the liquid dispense tube and the air dispense tube pass through the cap.

5. The refill unit if claim 1 wherein the liquid pump chamber and the air pump chamber are offset from a center of the outer housing.

6. The refill unit if claim 5 further comprising an annular projection on the cap and an actuator mechanism located at least partially in the annular projection, and wherein the actuator mechanism engages at least one of the air piston and the liquid piston to move the at least one of the air piston and the liquid piston to move fluid.

7. The refill unit of claim 6 wherein the annular projection is located on a center of the outer housing.

8. The refill unit if claim 1 further comprising a container vent passage, wherein the container vent passage is closed when the foam pump is in a rest position and the container vent passage opens when the foam pump is activated.

9. The refill unit if claim 1 wherein the air tube and the liquid tube are concentric.

10. The refill unit if claim 1 wherein the air tube surrounds the liquid tube.

11. A foam pump comprising:
an outer housing;
an inner housing;

an air pump chamber;

a liquid pump chamber, wherein the liquid pump chamber is defined at least in part by the inner housing, the outer housing, a liquid inlet valve and a liquid outlet valve;

an air outlet passage;

a liquid outlet passage;

wherein the air pump chamber at least partially surrounds the liquid pump chamber;

wherein at least a portion of the liquid pump chamber surrounds a first portion of the air outlet passage; and wherein a second portion of the air outlet passage surrounds a portion of the liquid outlet passage.

12. The foam pump of claim 11 wherein the second portion of the air outlet passage and the liquid outlet passage comprise concentric tubes and extend upward to a mixing chamber.

13. The foam pump of claim 11 wherein at least a portion of one of the first and second portions of the air outlet passage is formed by the inner housing and the outer housing.

14. The foam pump of claim 11 further comprising an air piston and a liquid piston.

15. The foam pump of claim 11 wherein the foam pump is configured to be disposed in a neck of a container.

16. A refill unit for a foam dispenser comprising:

a container;

the container having a neck;

a foam pump secured to the neck;

the foam pump having an outer housing;

at least a portion of the outer housing located within the neck of the container;

an inner housing located at least partially within the outer housing;

a liquid pump chamber formed at least partially by the inner housing, the outer housing, a liquid inlet valve and a liquid outlet valve;

an air pump chamber formed at least partially by the inner housing;

an air outlet passage extending from the air pump chamber;

the air outlet passage formed at least partially by the inner housing and the outer housing;

wherein the liquid pump chamber is located at least partially within the air pump chamber;

a liquid dispense tube extending upward from the foam pump; and an air dispense tube extending upward from the foam pump;

wherein the liquid dispense tube and the air dispense tube remain stationary when the foam pump pumps air and liquid.

17. The refill unit of claim 16 wherein the air pump chamber and the liquid pump chamber are offset from a center of the neck.

18. The refill unit of claim 16 further comprising an air passage located at least partially between the inner housing and the outer housing for venting the container.

* * * * *